United States Patent [19]

Fischer

[11] Patent Number: 4,620,482

[45] Date of Patent: Nov. 4, 1986

[54] ROTARY PRINTING MACHINE CYLINDER BLANKET CONSTRUCTION AND INSERTION TOOL

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 657,193

[22] Filed: Oct. 3, 1984

[30] Foreign Application Priority Data

Oct. 22, 1983 [DE] Fed. Rep. of Germany ..... 3338450

[51] Int. Cl.[4] ..... B41F 27/06

[52] U.S. Cl. ..... 101/415.1; 400/250

[58] Field of Search ..... 101/415.1, 378, 250, 101/132, 132.5, 141, 142; 51/369, 367; 428/909

[56] References Cited

U.S. PATENT DOCUMENTS

| | | | |
|---|---|---|---|
| 872,113 | 11/1907 | Enders | 400/250 |
| 2,402,706 | 6/1946 | Sprigg | 101/415.1 |
| 2,775,198 | 12/1956 | Johnson et al. | 101/415.1 |
| 2,831,562 | 4/1958 | Saliamonas | 400/641 |
| 2,850,970 | 9/1958 | Brodie | 101/415.1 |
| 3,791,295 | 2/1974 | Albright | 101/415.1 |

FOREIGN PATENT DOCUMENTS

| | | | |
|---|---|---|---|
| 498900 | 5/1930 | Fed. Rep. of Germany | 400/250 |
| 553002 | 5/1923 | France | 101/415.1 |
| 14303 | of 1903 | United Kingdom | 101/415.1 |
| 515977 | 12/1939 | United Kingdom | 101/415.1 |

*Primary Examiner*—Edgar S. Burr
*Assistant Examiner*—Tonya Eckstine
*Attorney, Agent, or Firm*—Frishauf, Holtz, Goodman & Woodward

[57] ABSTRACT

To facilitate insertion of a rubber blanket into the groove or slot (2) of a blanket cylinder (1) of a printing machine, and to reduce the width of the opening (3) leading to the groove or slot, the thickness of the blanket is reduced in the end portion (11, 12), for example by removing a portion of the rubber blanket material; a reinforcement strip (14, 15, 20) is bonded to a textile substrate (9) on which the blanket layer (10) is applied, preferably at the side opposite of the blanket layer only. The end portions (11, 12) are formed with zones of reduced thickness, for example in the form of cut-outs in the textile substrate and extending into the rubber layer, to permit insertion of an inserting tool, such as metal strips, preferably in the form of tines (FIG. 4: 24) on an insertion fork (23), fitting into the reliefs or cut-outs (16, 17, 18), with clearance, to permit pushing the end of the blanket through the narrow gap (3) of the slot by engagement of the tines with the reinforcement strip (14, 15, 20).

12 Claims, 4 Drawing Figures

ROTARY PRINTING MACHINE CYLINDER BLANKET CONSTRUCTION AND INSERTION TOOL

The present invention relates to rotary printing machines, and more particularly to rotary printing machines which use a blanket cover over a printing machine cylinder, which blanket cover is introduced to a tensioning apparatus through a narrow slot or groove extending axially in the cylinder.

BACKGROUND

It is desirable to make the cylinder slots or grooves as narrow as possible so that, with a given cylinder diameter, as much space around the circumference can be used for printing as possible, and as little space as possible when the blanket is inserted for tensioning about the cylinder. The ends of a blanket, or similar cover, which is generally flexible, can be fitted into the groove usually only by use of tools. Typical tools which are used to assist in the insertion of blankets in the grooves are screwdrivers, painter's knives and scrapers, and other tools which are, generally, elongated and essentially flat, while being strong. In order to permit insertion of the ends of a covering blanket, the grooves have been made wide enough to permit insertion of one end portion, and then not only insertion of the second end portion but, additionally, provide space for a tool or pusher element which is used to assist in stretching a rubber blanket about the cylinder.

THE INVENTION

It is an object to so construct the rubber blanket that, in combination with a cylinder, the cylinder can then be made with a groove or slot which is narrower than heretofore possible, while, still, permitting ready insertion of the ends or end portions of the blanket into the cylinder groove.

Briefly, the blanket is formed at the ends with reinforcement zones which extend transversely with respect to the end portions and are located close to the terminal ends of the blanket. In accordance with the invention, a zone of reduced thickness of the blanket defines a depressed relief, which is formed in the end portions of the blanket and extends longitudinally from the reinforcing zone within the region of the end portion which is located within the groove or slot when the blanket is stretched about the circumference of the cylinder. The relief is long enough to permit access by a tool to the reinforcing zone through the relief. The tool can be fitted against the end portion, and specifically the reinforcement zone, to place the end portion into the stretching elements, for example rotatable spindles extending axially in the cylinder and capable of stretching a blanket about the circumference of the cylinder.

The arrangement has the advantage that the slot or groove formed in the cylinder need have a width which is only that of twice the width of the blanket plus a very small clearance space, for example only a fraction of a millimeter.

DRAWINGS

DETAILED DESCRIPTION

Figure 1:
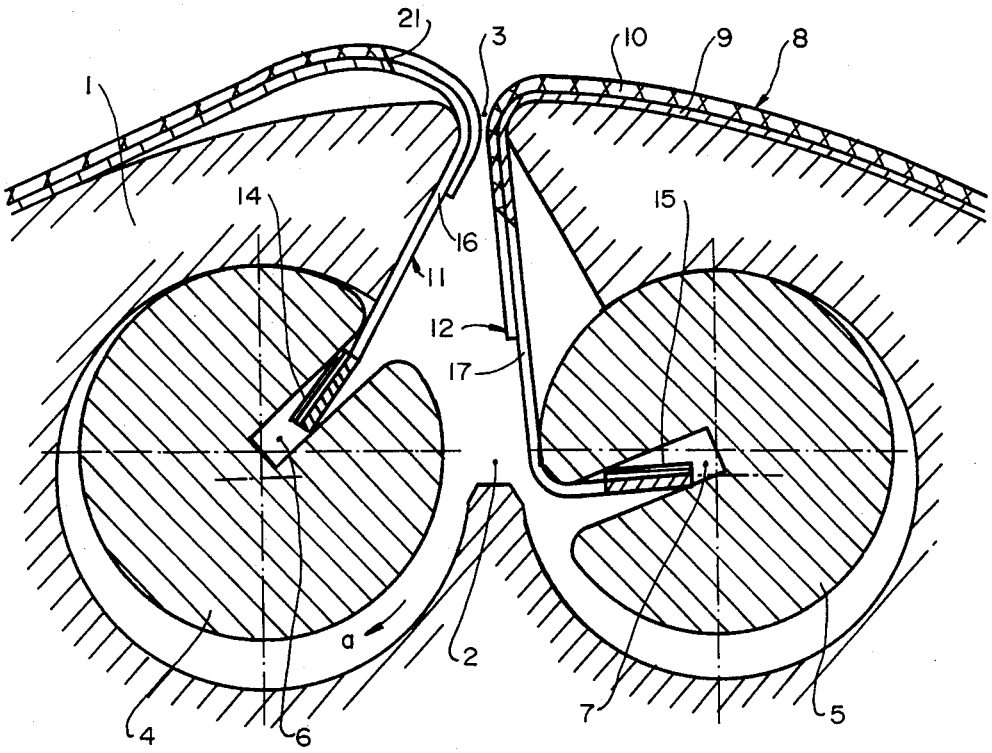
FIG. 1 is a schematic fractional transverse view through a blanket cylinder of a rotary printing machine with a flexible blanket placed thereon, in which the right portion of the blanket is illustrated in the stretched position and the left portion of the blanket in the position before the left portion is stretched.

The invention will be described in connection with a rotary offset printing machine; reference will made hereinafter to a "rubber blanket" although, of course, it must be understood that the term "rubber blanket" does not necessarily mean that the blanket is coated with a rubber layer; other ink-transferring materials, such as plastic and the like, may be used.

A rubber blanket cylinder 1 has an axially extending groove or slot 2. The slot 2 is accessible from the outside through a small slot opening 3. The interior of the slot receives stretching and holding elements for the blanket 8, as shown, two tensioning spindles 4, 5, each formed with an axial groove 6, 7. Upon insertion of an end portion of the blanket into the axial grooves 6, 7, the blanket can be tightened, as well known. The flexible blanket 8 is shown, in the present embodiment, as a two-layer rubber blanket, which has a woven textile substrate 9 and a cover layer 10 which is made of rubber or other similar ink-transferring material. The flexible blanket 8 has two end portions 11, 12 which, when the blanket is stretched about the cylinder, are entirely retained within the slot 2, as shown at the right portion of FIG. 1. The end portions 11, 12 have reinforcement zones 14, 15 at their terminal ends, for example in the form of metal strips which are bonded to the textile web. The reinforcements, preferably, are located at the side of the textile web 9 which is opposite that of the rubber cover layer 10, so that the forces which act on the bonding connection of the reinforcement strips and the textile substrate can be reduced.

In accordance with the invention, the end portions 11, 12 are formed with reliefs 16, 17, which extend from the reinforcements 14, 15 towards the other terminal end of the end portions 11, 12. These reliefs, which can be formed as cut-outs, in the form of notches or the like—see FIG. 2—are so dimensioned longitudinally—with respect to the blanket—that, when the blanket 8 is stretched about the cylinder, the reliefs 16, 17 are located entirely within the slot or groove 2, as shown at the right side of FIG. 1; before being stretched, however, and as shown at the left side of FIG. 1, a portion of the reliefs extends outside of the groove, thus providing, in the region of the reliefs, an enlarged opening leading to the inside of the slot or groove 2, and thus, effectively, in the zone of the reliefs, increasing the gap at the terminal opening region 3.

In the embodiment shown in FIG. 1, the cover layer 10 is removed in the region of the end portions 11, 12, so that the thickness of the material is decreased in the end portions. The reinforcement strips 14, 15 are located only on one side of the textile substrate web, and have a thickness which corresponds approximately to the thickness of the cover layer 10 which has been removed. Arranging the reinforcement strips, and the cover layers, in that manner, further simplifies introduction of the end portions 11, 12 into the groove 2 and into the tensioning or stretching spindles or rollers 4, 5.

Figure 2:
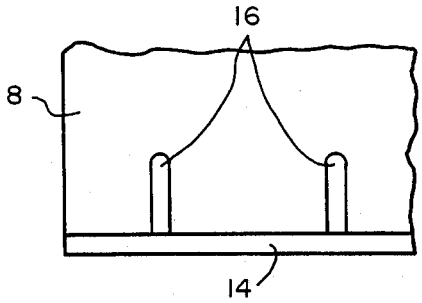
FIG. 2 is a fragmentary top view of the end portion of a flexible blanket.
Figure 3:
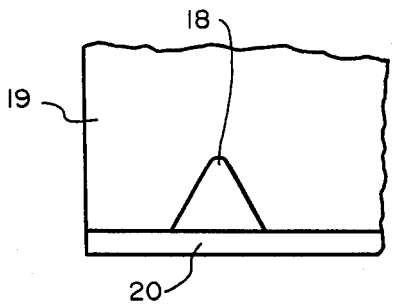
FIG. 3 is a fragmentary top view of the end portion of a flexible blanket and showing another embodiment of a relief zone.

Rather than making the reliefs in longitudinal slit form, as shown in FIG. 2, the reliefs can be formed, as shown in FIG. 3, in triangular shape, as seen at 18, on a flexible cover 19. Again, the reliefs may extend throughout the thickness of the textile substrate web 9, in form of cut-outs. In the embodiment of FIG. 3, one of the sides of the triangular relief 18 is formed by the reinforcement 20.

It is desirable, but not absolutely necessary, to form both ends of the blankets with the reliefs or cut-outs.

Blanket Insertion: Let it be assumed that the end portion 11 is to be introduced into the longitudinal groove 6 of the tensioning spindle 4. For example, a screwdriver, a knife, scraper, or other elongated blade which can be placed against the reinforcement 14, and is not substantially thicker than the reinforcement 4, and which can be located in the region of the cut-out or of the relief 16, is placed against the blanket. The end portion of the blanket is pushed by the tool into the groove 6 until the upper end 21 of the relief 16 engages the insertion tool. The insertion tool can be removed, and the tensioning spindle 4 rotated in the direction of the arrow a, to tighten and tension the blanket 8. Upon rotation of the spindle 4 in the direction of the arrow a, the limit end 21 of the insertion portion is pulled into the groove 2, as seen at the right side of FIG. 1 with respect to the end portion 12. The right side of FIG. 1 illustrates an end portion of the flexible blanket 8 which is already inserted and tensioned. The surface of the blanket cylinder, thus, at the outside will not have any portion of the blanket 8 which is formed with reliefs or cut-outs.

Figure 4:
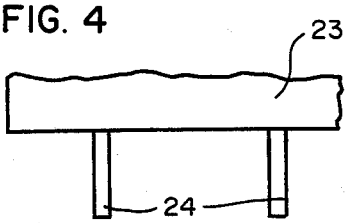
FIG. 4 is a fragmentary top view of an insertion tool for use, for example, with the blanket of FIG. 2.

It is desirable to form a plurality of reliefs or cut-outs 16, 17 distributed over the entire width of the blanket, that is, over the width of the cylinder, so that the reinforcement is as uniform as possible. Rather than using single screwdrivers, knife elements, scrapers or the like, it is desirable to utilize an insertion tool as shown, in fragmentary form, in FIG. 4. The insertion tool is, essentially, a fork 23 which has a number of tines 24, corresponding to the number of reliefs or cut-outs, and similarly located. Each one of the tines 24 is so positioned that it will fit within a relief 16 or a cut-out on the blanket 4; the tines are, preferably, slightly narrower than the width of any one of the reliefs 16. The thickness of the tines is, preferably, at most equal to the thickness of the blanket, overall. By introducing an insertion fork 23, a single insertion push can be used to fit the entire end of the flexible cover 8, uniformly, into the tightening or tensioning device. The tightening or tensioning device may, of course, be constructed in a manner different from that shown in the drawing, which is merely provided for illustration, is highly suitable, but may be varied in accordance with design or construction requirements.

The relief zone or the cut-outs if the relief extends through the entire material of the blanket preferably is also formed in the portion of the blanket covered by the rubber layer, as seen in FIG. 1; the end zone 21 of the cut-out 16 is formed in both the rubber layer portion as well as the substrate portion of the blanket, the rubber layer portion terminating short of the reinforced end zones of the blanket, defined by the reinforcements 14, 15, respectively.

Various changes and modifications may be made. Of course, the shape of the tines 24, FIG. 4, can be matched to the shape of the reliefs or cut-outs, and an insertion fork, for example for blankets in accordance with FIG. 3 would have, preferably, tines which diverge in triangular shape, slightly smaller than the relief or the cut-out 18, but of similar shape.

I claim:

1. In a rotary printing machine blanket (8, 9) which, in plan view, is substantially rectangular, defining terminal edges, adapted for insertion into an axial slot or groove (2) through a peripheral opening (3) of a printing machine cylinder, said blanket having a reinforcement zone (14, 15, 20) extending transversely of an end portion (11, 12) of the blanket inwardly from said terminal edges, and located close to the terminal edges, wherein the cylinder is formed with blanket engagement means (4, 5; 6, 7) located within the slot or groove (2) for engaging the reinforcement zone of the blanket and for stretching the blanket about the circumference of the cylinder after insertion of the end portions (11, 12) of the blanket into the slot or groove, the improvement comprising the width of said peripheral opening being only slightly greater than twice the thickness of said blanket, and means to enable engagement of a tool with said reinforcement zone when said reinforcement zone is located within the slot or groove of the cylinder and the blanket is stretched about the circumference of the cylinder to positively insert said reinforcement zone within said blanket engagement means, said means to enable including a plurality of zones of reduced thickness of material of said blanket beginning at said reinforcement zone and extending longitudinally with respect to said blanket.

2. Blanket according to claim 1, wherein the zones of reduced thickness of material of the blanket comprise a plurality of transversely—with respect to the length of the blanket—located zone portions positioned in the end portions (11,12) and reduced in thickness with respect to the thickness of the material of the remainder of the blanket.

3. Blanket according to claim 2, wherein the blanket (8, 19) comprises a textile web substrate (9) and a cover layer (10);

and wherein, in the zones of reduced thickness, the blanket comprises only said substrate (9).

4. Blanket according to claim 1, wherein said reinforcement zones (14, 15, 20) comprise reinforcement strips located on one side only of the blanket (8).

5. Blanket according to claim 3, wherein said reinforcement zones (14, 15, 20) comprise reinforcement strips located on one side only of the blanket (8);

and wherein said reinforcement strips are located on the side of the substrate opposite that of the cover layer (10).

6. The combination of an insertion tool (23) with a blanket (8, 19) as defined in claim 1, wherein said tool comprises an insertion fork having a body portion (23) and projecting tines (24), said projecting tines being dimensioned and shaped to fit into the zones of reduced thickness (16, 17, 18) formed in the end portion of the blanket, with clearance.

7. The combination of claim 6, wherein the thickness of said tines is up to the overall thickness of said blanket;

and the terminal ends of the tines are dimensioned to fit against the reinforcement zones.

8. Blanket according to claim 1, wherein said zones of reduced thickness are cut-outs formed in the end portions of the blanket.

9. The combination of an insertion tool (23) with a blanket (8, 19) as defined in claim 8, wherein said tool comprises an insertion fork having a body portion (23) and projecting tines (24), said projecting tines being dimensioned and shaped to fit into the cut-outs (16, 17, 18) formed in the end portion of the blanket, with clearance.

10. Blanket according to claim 1, wherein the blanket comprises a textile substrate (9) and a rubber cover layer (10), the rubber cover layer terminating short of said terminal edges;

the reinforcement zones (14, 15, 20) comprise reinforcement strips located at said terminal edges and bonded to the textile substrate, positioned at the side of the textile substrate opposite the side of the rubber cover layer;

and wherein the zones of reduced thickness (16, 17, 18) are cut-outs extending through the textile substrate (9) and through the cover layer (10).

11. The combination of an insertion tool (23) with a blanket (8, 19) as defined in claim 10, wherein said tool comprises an insertion fork having a body portion (23) and projecting tines (24), said projecting tines being dimensioned and shaped to fit into the cut-outs (16, 17, 18) formed in the end portion of the blanket, with clearance.

12. The combination of claim 11, wherein the thickness of said tines is up to the overall thickness of said blanket;

and the terminal ends of the tines are dimensioned to fit against the reinforcement zones.

* * * * *